US005329636A

United States Patent [19]

Siddle

[11] Patent Number: 5,329,636

[45] Date of Patent: Jul. 19, 1994

[54] SAFETY CONTAINMENT SHIELD

[76] Inventor: Bruce K. Siddle, 306 Debra La., Waterloo, Ill. 62298

[21] Appl. No.: 684,826

[22] Filed: Apr. 15, 1991

[51] Int. Cl.[5] ..... A41D 13/00

[52] U.S. Cl. ..... 2/2; 2/2.5; 2/92

[58] Field of Search ..... 2/2, 2.5, 92; 109/49.5, 109/102; 224/907; 428/911; 294/131; 294/131; 89/36.01, 36.02, 36.05, 36.07

[56] References Cited

U.S. PATENT DOCUMENTS

| | | | |
|---|---|---|---|
| 1,895,197 | 1/1933 | Martinson | 2/2.5 |
| 2,020,702 | 11/1935 | Russell | 2/2.5 |
| 2,316,055 | 4/1943 | Davey | 2/2.5 |
| 2,526,217 | 10/1950 | Gilman | 2/2 |
| 2,574,046 | 11/1951 | Logan | 2/2 |
| 3,370,302 | 2/1968 | Karlyn | 2/2.5 |
| 3,829,899 | 8/1974 | Davis | 2/2.5 |
| 4,412,495 | 11/1983 | Sankar | 2/2.5 |
| 4,422,183 | 12/1983 | Landi et al. | 2/2 |
| 4,674,394 | 6/1987 | Martino | 2/2.5 |
| 4,843,947 | 7/1989 | Bauer et al. | 2/2.5 |

*Primary Examiner*—Clifford D. Crowder
*Assistant Examiner*—Gloria Hale
*Attorney, Agent, or Firm*—Paul M. Denk

[57] ABSTRACT

A safety containment shield for use by the authorities to protect the officer during usage, and to minimize damage to the person confronted. The shield is a composite of laminar material, including a sheet of rigid polymer, having foam cushioning layers provided on both its front and back surfaces. An outer covering of canvas or vinyl is provided, and hand gripping means, in the form of arm straps, are furnished upon the backside, to facilitate the grasp by the user, particularly during participation in a conflict.

4 Claims, 2 Drawing Sheets

SAFETY CONTAINMENT SHIELD

BACKGROUND OF THE INVENTION

The general concept of this current invention is to provide a shield, fabricated from a variety of materials, that add not only to its structural integrity during application and usage, but afford protection and safety to both the user, and the parties against whom the shield is presented, so that the shield can be used for both offensive purposes, for self protection, and as a defense in such situations as crowd control, and close combat.

While the general concept of any shield obviously cannot be considered as new, the structure of the current invention, it is believed and submitted, contains a combination of materials and components that make it rather unique, in comparison with shields as heretofore known and used. Metal shields have been used for centuries. Whole armies were equipped with metal shields, having hand gripping holders provided upon the backside, and generally were used as a defense against the application of swords, spears, and arrows, when men entered into combat. It does not appear, though, that much innovation has taken place in the design, configuration, and construction of shields as currently used, nor does it appear that such shields have been given any extensive usage, as an item of equipment for use by the military, police, or crowd control authorities, under present circumstances. Obviously, shields generally provide the officer with a means to shelter his/her own body from the physical force exerted by others, but, the shield of this current invention is designed to incorporate various cushioning means, that not only affords protection to the user, should the shield be thrusted rearwardly, as a result of an impacting force, and impact against the person, and in addition, the provision of means for minimizing any injury to the party or crowd under surveillance, and intended to be controlled, does not appear to have been given advancing thought. The purpose for considering these factors, from all standpoints, needs consideration this day and age, particularly when one views the proliferation of law suits that are being filed against municipalities, the police authorities, and the individual officer, for injury that has been sustained by any suspect, a crowd under control, or the like, who claim that the police utilized extraordinary force, beyond the call of duty, when exercising their authority. Monetary damages, quite excessive, have been awarded by juries to such victims, which requires the authorities to now give consideration as to further means to implement safeguards, even while attempting to uphold the law against suspects, or the criminals.

SUMMARY OF THE INVENTION

It is the principal object of the current invention to provide innovations in the structure of a safety containment shield, which significantly improves upon an old idea, in the provision of a shield itself for use by the authorities, and constructing it of various components that add to its strength, for the safety of the user, and to incorporate means for minimizing damage to those against whom the shield is used, without detracting from its effectiveness during application.

The construction of the shield of this invention is designed upon the laminar concept that the layering of specific materials together can add a multitude of useful results to be derived from its application. The shield of this invention incorporates inherently a protective layer of material, so as to resist, if not retard, the penetration of any form of projectile, when shot at the officer, and this is achieved through the usage of a solid polymer sheet of material, such as a Lexan, arranged internally of the shield's structure. To the front of the sheet is disposed a layer of cushioning material, comprising a polymer foam, generally of the open celled configuration, so that it will provide a significant degree of cushioning, to the front of the shield, such as when it is impacted against another, during its usage. Provided to the back of the sheet of rigid polymer material is a thinner layer of cellular foam, also generally constructed of a polymer, and preferably of a more closed cell foam that is of a denser configuration, thereby allowing a thinner sheet of such foam to be utilized, and add to the rigidity of the shield, at this location, so as to facilitate its grasping, handling, and manipulation by the officer during its usage. A high strength canvas covering is provided over the entire composite of layered materials, in order to assure its integrity when held together, during repeat usage, and to sustain its useful life. In addition, a series of grasping means, in the configuration of a plurality of straps, are provided at various angulations along the backside of the shield, adhered in place by means of an adhesive, stitching, or the like, at select positions, to provide a series of locations where the officer can promptly grab the shield, for ready application, when emergency conditions require such.

Generally, the usage and application of this shield has been defined as being used principally by those in authority, such as the police, or the military, but it is just as likely that a shield of this type could also be utilized by those who participate in other strenuous activities, such as the persons who practice and partake in competitive activities involving the martial arts, and related events.

It is, therefore, a principal object of the current invention to provide a uniquely designed and constructed safety shield, to add to the protection of not only its user, but also those who are confronted by the .shield during its usage and application.

Another object of this invention is to provide a laminar form of shield, as distinct from those heretofore designed, that incorporates rigidity in its structure for safety purposes, but at the same time contains various means for cushioning the degree of impact sustained by the party against whom the shield is presented, in addition to the user himself/herself.

Still another object of this invention is to provide a safety containment shield, which is fabricated to dimensions that provide adequate sheltering to its user, but at the same time, being of reasonable size so as to not encumber the dexterity of its user, when involved in such hazardous activities as crowd control, or suspect apprehension.

Another object of this invention is to provide a safety containment shield that is designed to cushion against forced cell entry impact while protecting the officer from any edged weapon assault.

Still another object of this current invention is to provide a safety containment shield that is reasonably self sealing, from the standpoint that should any sharp object be embedded in the shield, and then removed, the foamed cushioning material being inherently resilient will undertake its original configuration, and close in preparation for encountering any additional force that may be exerted against it, during emergency activity.

Yet another object of this invention is to provide a safety shield that contains no sharp edges, such as presented by shields of the prior art.

Still another object of this invention is to provide a shield that contains internal structure that is highly resistant to any knife attack, and may even lessen or retard the penetration of projectiles.

Still another object of this invention is to provide a shield that incorporates a series of grasping means, upon its backside, and angulated in a variety of directions, so that it can be readily grasped by the officer, for emergency usage, from any direction, and held either horizontally, or vertically, during its application and usage, depending upon the type of attack encountered.

Still another object of this invention is to provide handle means for a safety containment shield and which are cushioned in their structure so as to make them easier of grasping and holding, and present no reasonably jagged or sharp edges to the hand, or forearm, during its retention.

Other objects and purposes will occur to those skilled in the art upon reviewing this summary of the invention, and upon undertaking a study of the description of its preferred embodiment, in view of the drawings.

DESCRIPTION OF THE PREFERRED EMBODIMENT

Figure 1:
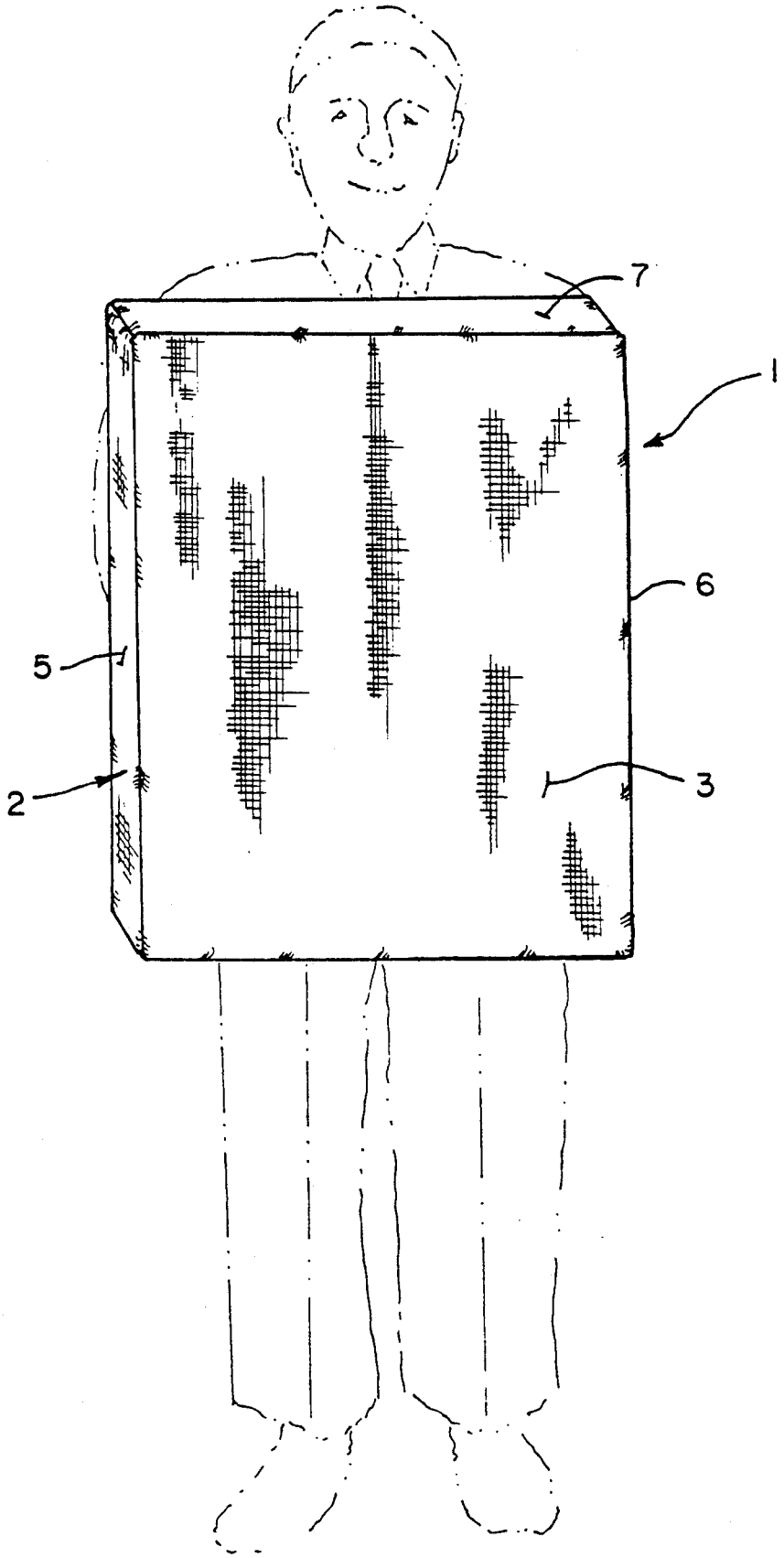
FIG. 1 provides an isometric view of the safety containment shield of this invention, being held by an officer, as shown in phantom line.
Figure 2:
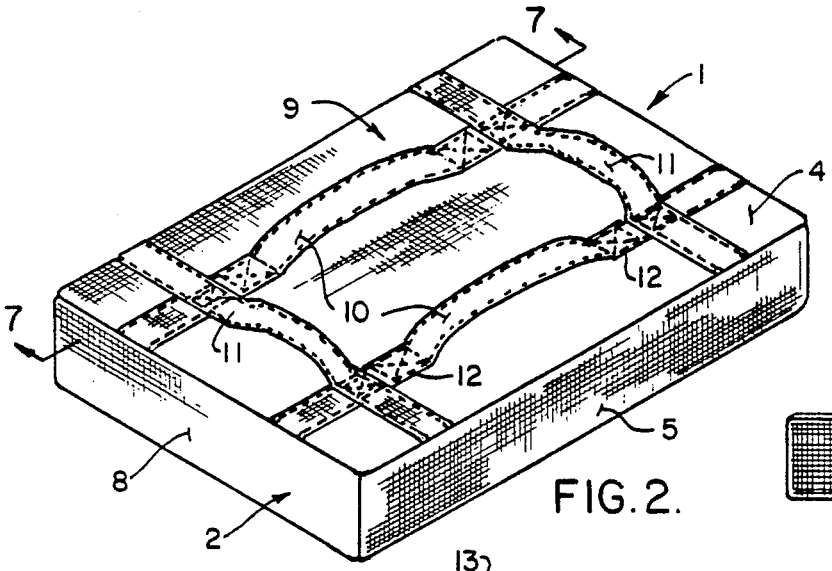
FIG. 2 is an isometric view of the backside of the safety containment shield of this invention.
Figure 3:
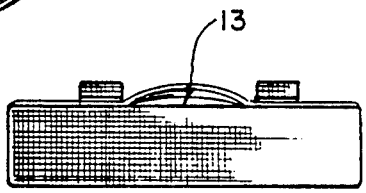
FIG. 3 is a top or bottom edge view of the shield.
Figure 4:
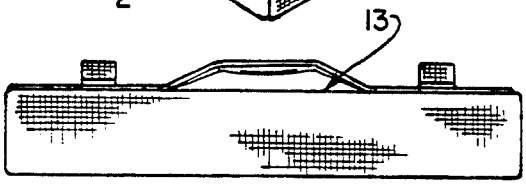
FIG. 4 is a side view of the shield.
Figure 5:
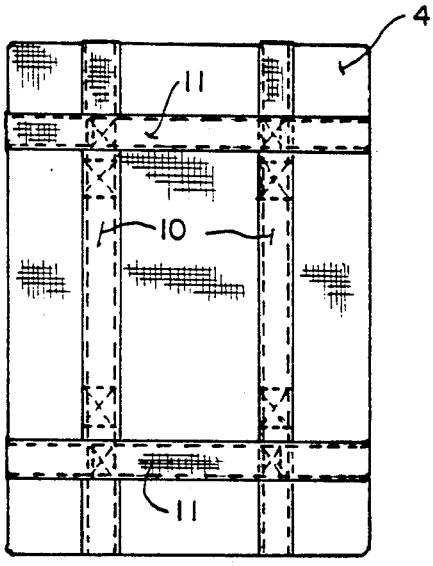
FIG. 5 is a back elevational view of the shield.
Figure 6:
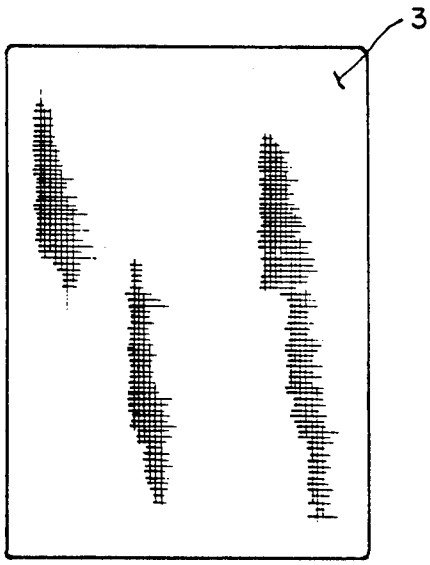
FIG. 6 is a front elevational view of the shield.

In referring to the drawings, and in particular FIGS. 1 and 2, the safety containment shield of this invention is shown in its entirety. The shield 1 is disclosed as generally having a rectangular configuration, but obviously, other shapes, such as square, oval, round, or the like, could be used in the fabrication and construction of the shield, and operate effectively for the purposes of its design. The general position of usage of this device, on the other hand, is adquately shown in FIG. 1, as being held by its user, which in this particular instance, may comprise the police, a soldier, or others in authority. Likewise, those participating in the martial arts may find usage and application for this particular shield. As disclosed, the shield is fabricated to the shape as shown, and has some thickness, as shown at 2, and generally presents a shield having a front surface 3, a back surface 4, side edges 5 and 6, and top and bottom edges 7 and 8. As can also be seen in FIG. 2, there are a series of gripping means, as at 9, provided upon the backside of the shield, and these comprise a series of straps, some being arranged longitudinally, or heightwise, as at 10, while others are arranged transversely, as at 11, all disposed for the convenience of the user, and to facilitate a rapid grasp, and firm retention, of the shield, during its application and usage. For example, the arm of the holder may insert through a first parallel strap, with the hand then grasping the other strap, in order to assure snug retention of the shield, and its stable application, during usage. As can be seen, each of the straps are firmly adhered to the backside of the shield, either by stitching, as at 12, or by other available means such as adhesive, or the like. They present just enough clearance, as can be seen at 13, as in FIGS. 3 and 4, to allow the arm to be inserted therein, to assure firm grasping of the shield.

Figure 7:
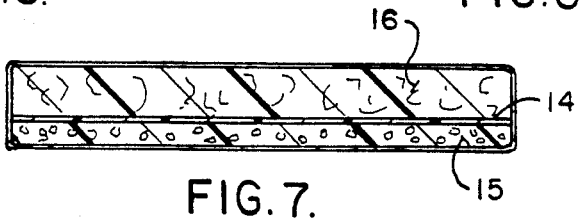
FIG. 7 is a longitudinal sectional view, taken heightwise, along the line 7—7 of FIG. 2.

In its configuration, as previously summarized, the shield is constructed of laminar materials, and for the variety of reasons as described. Initially, a rigid sheet of material is provided as the base structure, and this sheet, as noted at 14, is formed of a rigid polymer or other material, such as a quarter inch solid Laxan. Obviously, other rigid polymer materials, or metal, could even be used for this purpose. See FIG. 7. Laminated upon this sheet is a thinner sheet of cellular material, as at 15, and generally this sheet of material will comprise a cellular foam, such as a polyurethane foam, and since it is designed to be of a slightly tighter texture, a closed cellular foam is preferred. Obviously, though, other configurations of cushioning material could be used at this location, such as excelsior, cotton, or other cushioning material that adds some degree of softness, to the backside of the shield, for the protection of the user. On the other hand, it is desired that the cushioning material 15, at this location be of a firmer texture, in order to assure adequate stability to the straps 10 and 11 as mounted in proximity thereagainst. Provided upon the front of the shield, and aligned upon the rigid sheet 14, is a further layer of cushioning material, as at 16. This cushioning material likewise may be formed of a cellular foam, such as a polyurethane, or the like, or of any related or equivalent type of cushioning material, as previously analyzed, but in the preferred embodiment, it will be of an open cellular foam texture, in order to add a little further cushioning to the front of the shield, for purposes as previously described. As can be seen, the composite of laminar materials are generally of the same dimensions, both width and heightwise, in order to form a composite, and overlying the combination is an outer covering, which in this particular instance, completely envelopes the shield, in its construction. This outer covering may comprise a sturdy and resistant canvas, or vinyl, or any equivalent or related material, and which can resist against abrasions, as when encountering a knife, during a conflict. But, as previously explained, even should the covering succumb to any impact, such as the thrust of a knife, once it is removed, the cellular foam material, being highly resiliant, closes, and becomes rather self-sealing, or self-healing, particularly when confronted by puncture weapon assaults. Thus, the shield can be continuously used, by the officer, throughout the combat, without reducing his/her safety against injury. The general dimensions of the preferred embodiment, as shown in the drawings, may comprise a shield that is approximately 4.75 inches thick, 29.5 inches high, and 17.0 inches wide. The rigid sheet of solid Lexan, or the like, may be of a quarter inch dimension, the outer cellular foam may be up to 4 inches thick, while the closed cellular foam, as at 15, may be up to a 2 inch thickness dimension. The outer covering, as previously explained, may be formed of a heavy canvas, a vinyl, or other polymer, and the preferred embodiment is constructed of a covering material identified in the trade as Propex. These are examples of commercial means utilized in the construction of this safety containment shield.

The gripping means 10 and 11, and particularly those segments between the fastening means 12, may likewise be formed of a cushioning material, or comprise a double layer of strap, having some filler material contained therein, in order to aid to the comfort of its user, when the strap biases against the forearm, and likewise provide adequate bulk for gripping by the hand, for the convenience of the user.

Variations or modifications to the subject matter of this invention may occur to those skilled in the art upon reviewing the subject matter of this disclosure. Such variations or modifications, if within the spirit of this invention, are intended to be encompassed within the scope of any claims to patent protection issuing upon this invention. The description of the preferred embodiment set forth herein is done so for illustrative purposes only.

Having thus described the invention what is claimed and desired to be secured by Letters Patent is:

1. A safety containment shield for use for protective purposes, said shield incorporating a series of layers of material located adjacent to each other, one of said layers of material being a hardened configuration to resist impact, another of said layers being formed of a cushioned material, said one layer and said another layer being contiguous, and a third layer of said layers of material being an overlying covering, said overlying covering contiguously encasing the said one and said another layers, means connecting to the shield to provide for grasping by the user during application of the shield, said means comprising a strap, said layer of hardened material comprising a sheet of polymer, said sheet of cushioned material comprising a polymer foam, said strap means for grasping of the shield comprising at least one strap means for grasping by the hand to facilitate a holding of the shield during application and usage of the shield, said shield having opposite side edges, and said strap means for grasping by the hand connecting to the shield and extending approximately from one side edge of the shield to an opposite side edge, and having clearance intermediate thereof for grasping of the strap by the arm of the user during application of the shield, said covering material comprising a canvas cloth having a strength to substantially resist impact, the canvas cloth enveloping the entire exterior of the shield, said shield being light of weight to facilitate its maneuvering during application and usage by the user, said polymer sheet having a front surface and a back surface, said polymer sheet extending from one side edge to the opposite side edge of the shield, said polymer foam material having a thickness of approximately one inch to four inches and disposed along the front surface of the hardened polymer sheet, said foam material arranged between the hardened polymer sheet and the overlying covering material, a second foamed polymer sheet provided upon the backside of the hardened polymer sheet of material to add cushioning to the shield upon its backside and to minimize injury to the user during application of the shield, said backside arranged layer of cushioning material being approximately two to four inches in thickness.

2. The invention of claim 1 and wherein said shield having a front side and a backside, there are a series of straps provided upon the backside of the shield to add to the dexterity of grasping and holding of the shield during its application and usage.

3. The invention of claim 2 wherein said shield having opposite side edges and upper and lower edges, there is at least one strap extending transversely, said strap extending from one side edge to the other, along the backside of the shield, and at least another strap extending heightwise, from an upper to a lower edge along the backside of the said shield.

4. The invention of claim 3 wherein there are a pair of parallel arranged straps extending from one side edge to the other side edge along the backside of the shield, and there are a pair of heightwise disposed straps, parallel arranged, extending approximately from an upper edge to approximately a lower edge along the backside of the shield, to facilitate its grasping and holding by the user during its application.

* * * * *